US005930855A

United States Patent [19]

Vande Haar et al.

[11] Patent Number: 5,930,855

[45] Date of Patent: Aug. 3, 1999

[54] ACCELEROMETER FOR OPTIMIZING SPEED OF CLOTHES WASHER

[75] Inventors: Evan R. Vande Haar, Pella; Douglas A. Ochsner; John F. Broker, both of Newton, all of Iowa

[73] Assignee: Maytag Corporation, Newton, Iowa

[21] Appl. No.: 08/997,321

[22] Filed: Dec. 23, 1997

[51] Int. Cl.[6] ..... D06F 33/02

[52] U.S. Cl. ..... 8/159; 68/12.06; 68/12.14

[58] Field of Search ..... 8/159; 68/12.06, 68/12.14; 210/144; 74/573 R

[56] References Cited

U.S. PATENT DOCUMENTS 4,513,464 4/1985 Rettich et al. ..... 68/12.14 X
4,782,544 11/1988 Nystuen et al. ..... 8/159
4,843,671 7/1989 Hirooka et al. ..... 68/12.14 X
5,181,398 1/1993 Tanaka et al. ..... 68/12.06
5,671,494 9/1997 Civanelli et al. ..... 68/12.06 X
5,720,066 2/1998 Kim ..... 68/12.06 X
5,768,731 6/1998 Do ..... 68/12.06 X

*Primary Examiner*—Philip R. Coe
*Attorney, Agent, or Firm*—Zarley, McKee, Thomte, Voorhees & Sease

[57] ABSTRACT

A method and apparatus for optimizing the rotational speed of a washing machine tub to minimize washing machine vibration. The washing machine uses an accelerometer to sense machine vibration. A computer software program monitors, records, and compares machine vibrations over a range of rotational speeds to determine a rotational speed which minimizes machine vibration.

10 Claims, 3 Drawing Sheets

ACCELEROMETER FOR OPTIMIZING SPEED OF CLOTHES WASHER

BACKGROUND OF THE INVENTION

The present invention relates to laundry appliances, particularly clothes washing machines. More particularly, the present invention relates to a device and method for optimizing the rotational speed of a washing machine tub during the spin cycle so as to minimize washing machine vibration.

A tuned vibration absorber mounted to a clothes washer has been found to effectively reduce machine vibration. The vibration absorber is tuned to reduce machine vibration when the tub is rotated over a range of speeds and is most effective when it vibrates out of phase with the vibration of the washing machine. Such a vibration absorber is described in applicant's co-pending application Ser. No. 08/996,755, filed Dec. 23, 1997.

One difficulty with a vibration absorption system is that the tuned frequency of the absorber is dependent upon the mass attached to the absorber, the spring rate of the springs, the amount of clothes in the tub of the washing machine, floor conditions, and other installation conditions. Consequently, the optimum operational rotational speed for the tub varies from machine to machine, installation to installation and cycle to cycle. Thus, it is not sufficient to preset the controls of the washing machine to spin the tub at a certain rotational speed. For these reasons, there is a need for a device and method of determining the optimum rotational speed of the tub during each spin cycle to best utilize the vibration absorber and minimize machine vibration.

A general object of the present invention is the provision of an improved automatic washing machine.

A further object of the present invention is the provision of an automatic washing machine which determines the optimum rotational speed for the tub during each spin cycle.

A further object of the present invention is the provision of a method for determining the optimum rotational speed for the tub during each spin cycle.

A still further object of the present invention is the provision of a method for quickly determining the optimum rotational speed of the tub to minimize machine vibration.

These as well as other objects, features and advantages of the present invention will become apparent from the following specification and claims.

SUMMARY OF THE INVENTION

The present invention relates to a method and apparatus for optimizing the rotational speed of a washing machine tub during the spin cycle to minimize machine vibration. The method includes sensing and recording rotational speeds and machine vibrations over a range of rotational speeds to quickly determine the optimum speed. The method preferably includes a period of accelerating the washing machine tub to first locate a maximum vibration value and then an approximate minimum vibration value before the tub is decelerated towards the minimum value to more accurately select a rotational speed which minimizes washing machine vibration. The apparatus includes a variable speed washing machine and an accelerometer to sense machine vibration. The washing machine preferably includes a microprocessor, data storage memory circuitry, and computer software to analyze machine vibration and select an optimum speed to minimize machine vibration.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalents which may be included within the spirit and scope of the invention.

Figure 1:
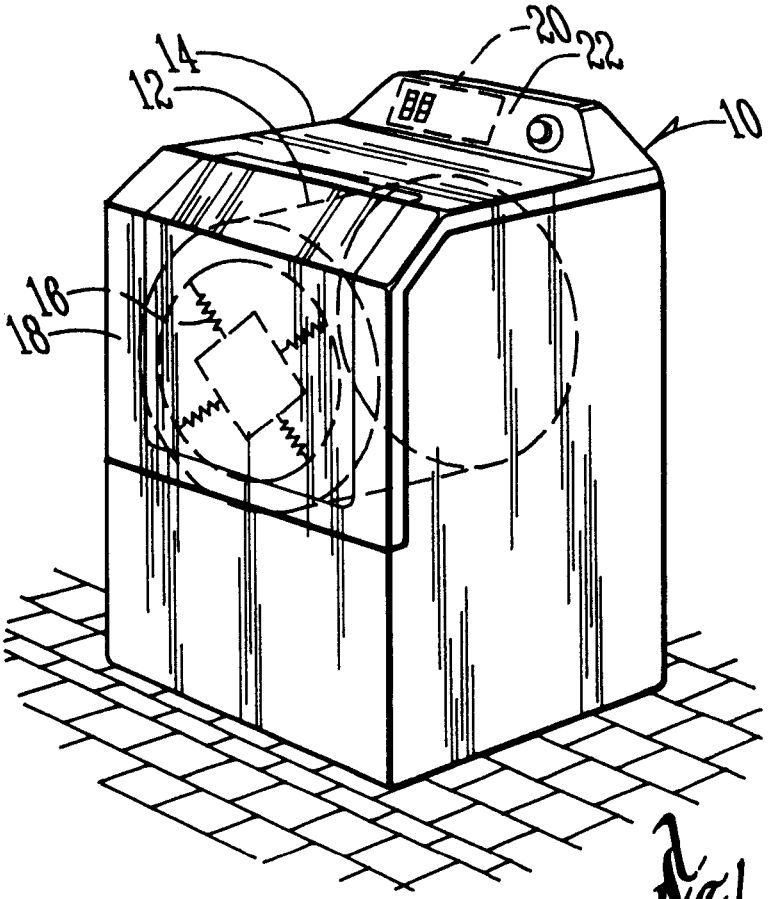
FIG. 1 is a perspective view of a washing machine used with the present invention.

FIG. 1 shows a clothes washing machine 10 having a tub 12 mounted within an enclosure 14. A multi-direction vibration absorber 16 is mounted inside the front door 18 adjacent the tub 12. To practice the invention, it is important that the tub 12 be capable of rotating at different speeds. Thus, a variable speed motor (not shown) is provided to rotate the tub 12. Although FIG. 1 shows a horizontal-axis washing machine, the present invention is also suitable for use with conventional vertical-axis washing machines.

The multi-direction vibration absorber 16 is tuned to vibrate in response to certain frequencies. The vibration absorber 16 comprises generally a mass suspended in the door 18 by a plurality of springs as shown in FIG. 1. The vibration absorber 16 is most effective at absorbing and controlling vibration when it vibrates out of phase with machine vibration. The details of the vibration absorber are disclosed in co-pending application Ser. No. 08/996,755, filed Dec. 23, 1997, which is incorporated by reference.

Figure 2:
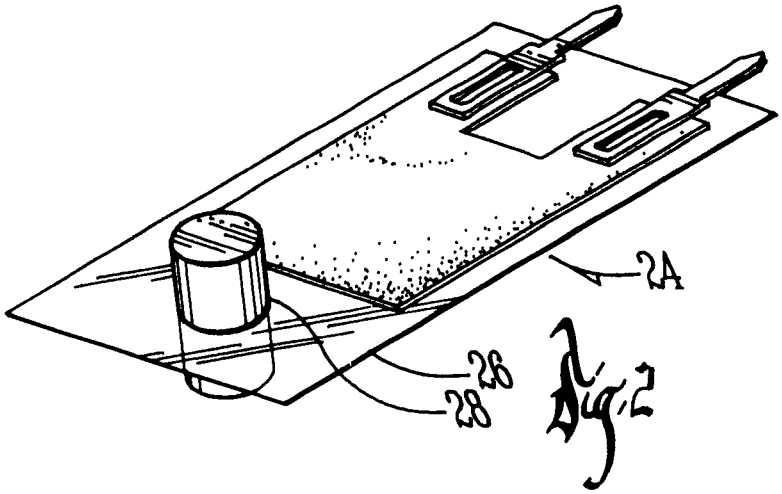
FIG. 2 is an enlarged perspective view of an accelerometer used to sense machine vibration during the spin cycle.

A control 20 is mounted within a console 22 for controlling the operation of the washing machine 10. An accelerometer 24 as shown in FIG. 2 is interfaced with the control 20 and is used to sense machine vibration. Although the accelerometer 24 can be positioned in a variety of different locations about the washing machine 10, mounting the accelerometer 24 towards the top of the washing machine 10 has been found to produce the most reliable measurements.

As shown in FIG. 2, the accelerometer 24 used with the present invention includes a piezoelectric film 26 with a mass 28 attached to the end of the film 26. The accelerometer 24 is well-suited for measuring vibration, as acceleration and vibration are proportional.

The control 20 of the preferred embodiment uses an 8-bit register to store vibration values to display an integer between 0–255 as a measurement of vibration. The control 20 also houses a micro-processor, data memory circuits and computer software.

A method is provided for determining the optimum rotational speed of the tub 12 at which machine vibration is at a minimum. In general, the computer software program interfaces with the control 20 to direct and monitor the rotational speed of the tub 12. The program reads vibration inputs from the accelerometer as the tub is accelerated over a range of rotational speeds. The program then, based on a comparison of the different vibration measurements, quickly and accurately identifies a range at which vibration is a minimum and directs the variable speed motor to decelerate the tub and focus around this minimum range. After more closely monitoring vibration about the minimum vibration range, the program then directs the variable speed motor to settle in at and maintain a rotational speed at which machine vibration is at a minimum.

Figure 3A:
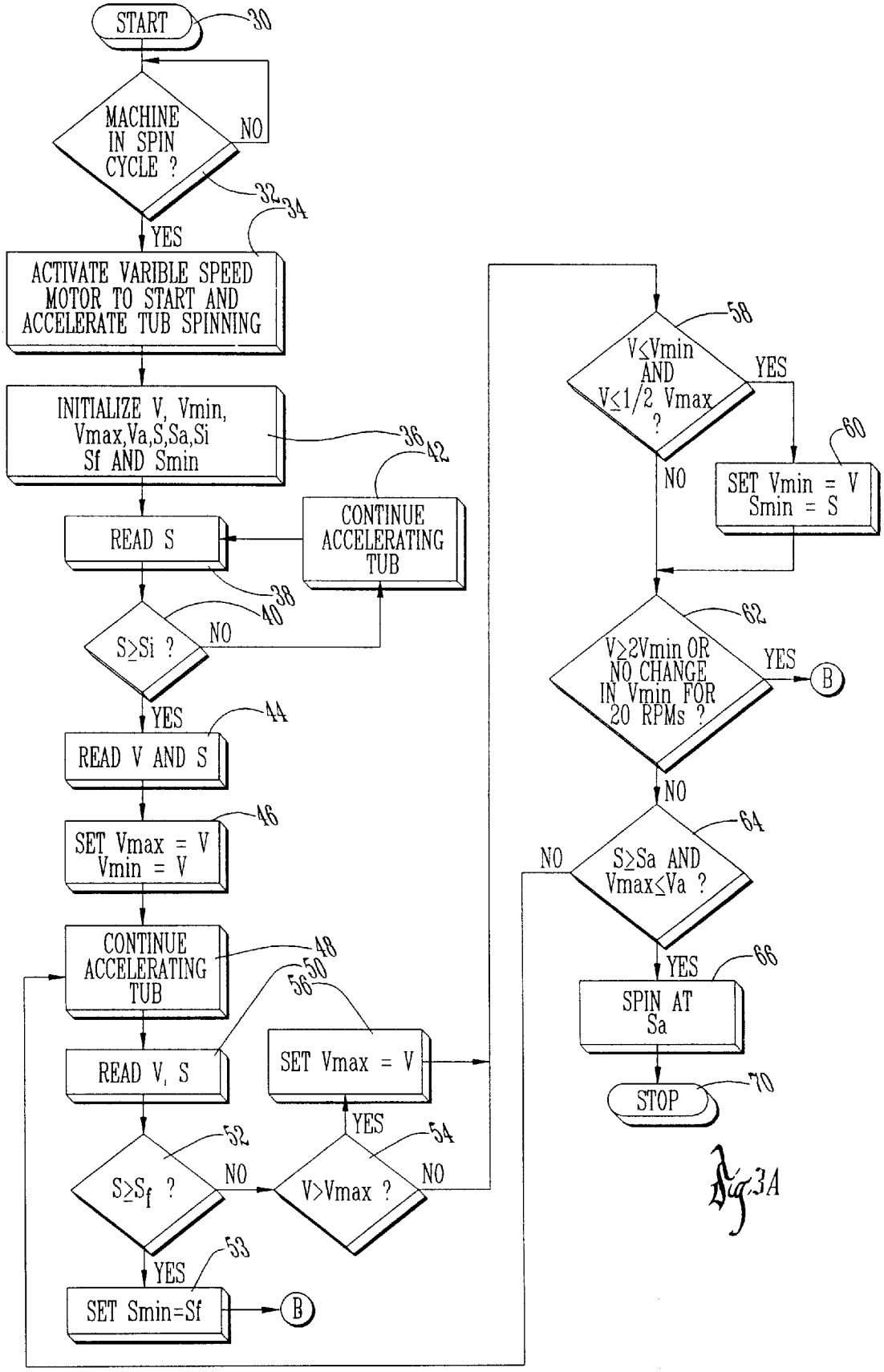
FIGS. 3A and 3B show a flow chart of the preferred method used to optimize rotational speed and machine vibration.
Figure 3B:
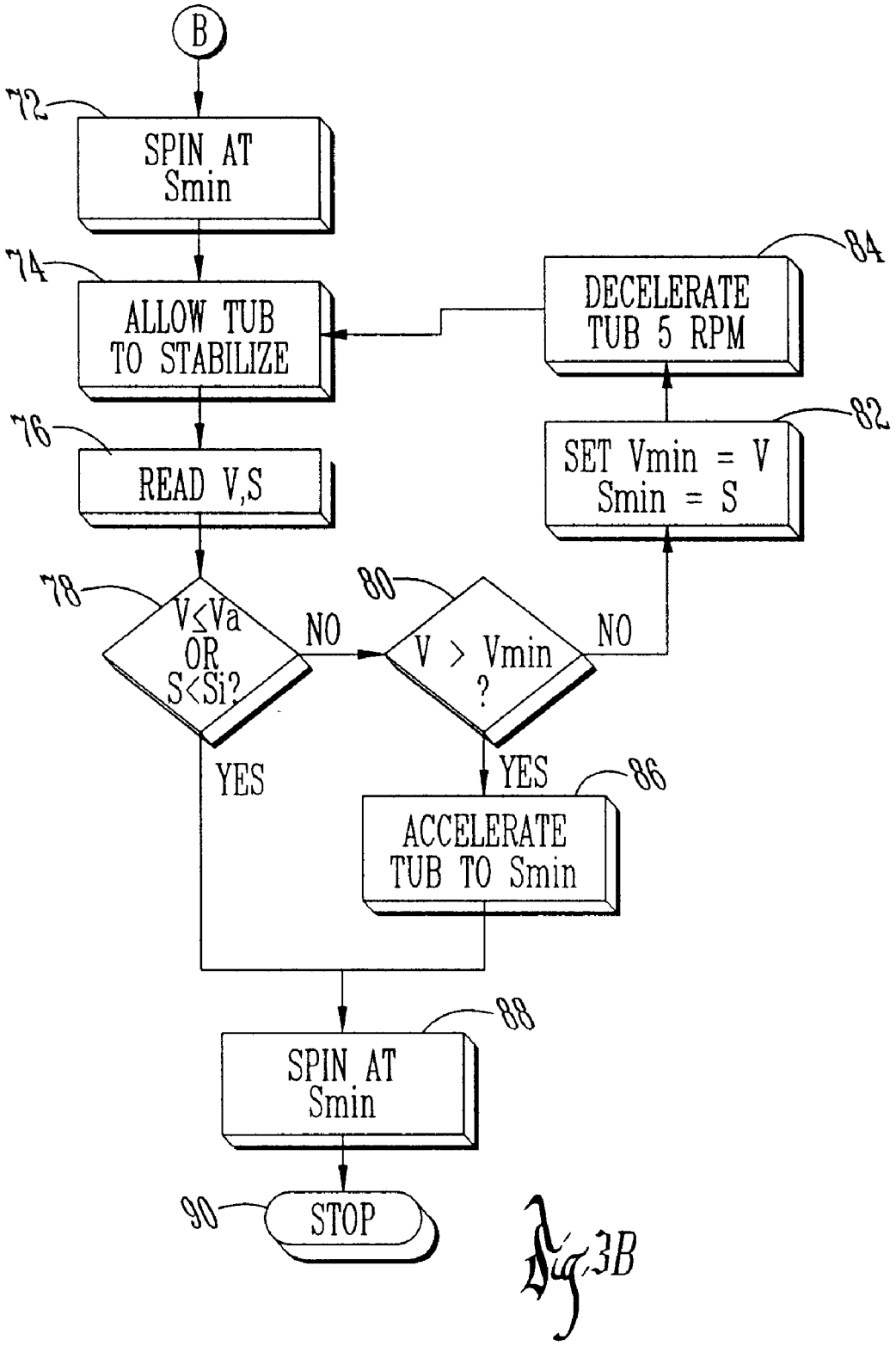

The method which has been found most effective in quickly and accurately determining an optimum rotational speed so as to minimize machine vibration is set out in FIGS. 3A and 3B. To aid in the description of the prepared method, each of the nodes are identified by a reference numeral. First, the computer software program monitors whether the washing machine 10 is in the spin cycle (32). Once the washing machine 10 enters the spin cycle, then the variable speed motor is activated to start and accelerate the tub 12 spinning (34). Parameters required for determining optimum values for rotational speed (S) and vibration (V) are initialized (36).

The program then continues to monitor the rotational speed (S) of the tub 12 until it reaches a threshold level ($S_i$) (see 38, 40 and 42). Experimentation has shown 740 rpm to be a suitable $S_i$ under normal conditions. Once the tub 12 reaches this threshold speed ($S_i$), then vibration values (V) from the accelerometer 24 are read (44). This initial reading sets both initial maximum and minimum vibration values ($V_{max}$, $V_{min}$) (46). The program will continue to update these values as it searches for a final value as described in detail below.

The preferred method first searches for a maximum vibration value ($V_{max}$). As acceleration continues, vibration is constantly read and recorded to establish the current maximum vibration value ($V_{max}$) (see 48, 50, 52, 54 and 56). The current vibration value (V) is always compared with a maximum vibration value ($V_{max}$) which is repeatedly updated (54, 56).

The tub 12 continues to accelerate throughout this initial period while searching for a maximum vibration value. Often machine vibration will be at a maximum just prior to entering a range of minimum vibration; accelerating the tub 12 past these maximum values lessens the effect of these spikes in vibration.

The maximum vibration value ($V_{max}$) is used as a benchmark in testing for a minimum vibration value ($V_{min}$). The program recognizes a minimum vibration value ($V_{min}$) as a vibration value less than the previous $V_{min}$ and less than or equal to one-half of $V_{max}$ (58, 60).

Once the current vibration value (V) reaches a level equal to or greater than twice the minimum vibration value ($V_{min}$), or there has been no change in the minimum vibration value ($V_{min}$) for 20 rpm, then the program assumes that the tub 12 has accelerated past a true minimum vibration value (62). Once this condition is satisfied, the method begins to search for a more accurate $V_{min}$ and the speed with the minimum vibration value ($V_{min}$) (see generally FIG. 3B). During some cycles this condition may not be satisfied before the tub reaches the upper limit of its rotational speed ($S_f$). In this case, the tub 12 is decelerated from this upper limit $S_f$ to fine tune the minimum ($V_{min}$) (see 52, 53). That is, the tub 12 can be decelerated without first satisfying the minimum vibration condition if rotational speed reaches a predetermined value ($S_f$), preferably 850 rpm. It is also possible that the tub will reach an acceptable level of vibration ($V_a$) before an actual minimum vibration level is found. In this case, the searching method is cut short and the tub 12 set to spin at $S_a$, the rotational speed corresponding to the acceptable level of vibration ($V_a$) (see 64, 66). In other words, when vibration is sufficiently low at a default high speed, preferably 810 rpm, then the program can break out of the optimization routine.

Tub 12 is incrementally decelerated while searching for a final minimum vibration value ($V_{min}$). That is, the tub 12 is stepped through certain rotational speeds in fine tuning the minimum vibration value ($V_{min}$). Rotational speed (S) and vibration (V) are recorded (76) as the tub 12 decelerates at increments of 5 rpm (84). The tub 12 is maintained at each increment for a sufficient time, preferably 5 to 7 seconds, to allow vibration to stabilize (74). Once a vibration reading is encountered which exceeds the continuously updated minimum vibration, then the tub is accelerated to the optimum rotational speed ($S_{min}$) and the corresponding minimum vibration level ($V_{min}$) (see 80, 86 and 88). This minimum vibration level corresponds to the rotational speed at which the vibration absorber 16 is at, or approximately, out of phase with machine vibration. Again, an acceptable vibration value ($V_a$) can be tested for to short cut the method (78). Also, the search can be stopped when the rotational speed reaches a threshold level ($S_f$) (78). This method of determining the optimum operational speed quickly reaches a desired setting without spending considerable time in ranges of high vibration.

It should be understood that this method is not dependent upon predetermined hard-coded values. For example, the threshold rotational speed ($S_i$), constants used to test for a true minimum vibration value ($V_{min}$), and rpm increments for decelerating the tub 12 can all be customized based on the size of the washer, type of vibration absorber, market requirements, installation conditions, etc.

It should also be understood that the method of the present invention may be used either with or without a tuned vibration absorber. In either case, the method finds an optimal speed to rotate the tub.

What is claimed is:

1. A method for determining the optimum speed at which to operate a machine having at least one movable element so as to minimize machine vibration, the method comprising:

accelerating and decelerating the movable element over a range of speeds;

sensing speeds and machine vibrations over the range of speeds;

comparing the machine vibrations over the range of speeds; and determining the speed at which the machine vibration is a minimum.

2. A method for optimizing the rotational speed of a washing machine tub to minimize vibration of a washing machine, the method comprising:

rotating the tub over a range of rotational speeds;

sensing rotational speeds and machine vibrations over the range of speeds;

comparing the machine vibrations over the range of rotational speeds;

determining the speed at which the machine vibration is a minimum.

3. A method for determining the optimum rotational speed to rotate a washing machine tub to minimize vibration of a washing machine, the method comprising:

rotating the tub;

accelerating the tub;

sensing vibration to set a maximum vibration value;

continuously sensing the rotational speed and the vibration;

comparing the sensed vibrations with the maximum vibration value and re-setting the maximum vibration value each time the sensed vibration is greater than the previously set value;

setting a minimum vibration value when one of said vibrations is less than a predetermined multiplier of the maximum vibration value;

decelerating the tub when one of the vibrations exceeds a predetermined multiplier of the minimum vibration value;

sensing rotational speeds and vibrations near the minimum vibration value last set; and maintaining the rotational speed at which the vibration is a minimum.

4. The method of claim 3 further comprising decelerating the tub if the minimum vibration value remains constant over a predetermined range of rotational speed.

5. The method of claim 4 wherein the predetermined range of rotational speed is 20 rpm.

6. The method of claim 3 wherein the predetermined multiplier of the maximum vibration value is ½.

7. The method of claim 3 wherein the predetermined multiplier of the minimum vibration value is 2.

8. The method of claim 3 wherein the tub is maintained at a default high rotational speed if the vibration is sufficiently low.

9. The method of claim 3 wherein the tub decelerating at predefined increments of rotational speed.

10. The method of claim 9 wherein the vibration of the washing machine is stabilized at each of the rotational speed increments before sensing the rotational speed and vibration.

* * * * *